US005743809A

United States Patent [19]

Lehman

[11] Patent Number: 5,743,809

[45] Date of Patent: Apr. 28, 1998

[54] BAMBOO GOLF CLUB SHAFT

[76] Inventor: S. D. Lehman, 1717 Gascony Rd., Encinitas, Calif. 92024

[21] Appl. No.: 746,094

[22] Filed: Nov. 6, 1996

[51] Int. Cl.[6] ..... A63B 53/02; A63B 53/10; A63B 53/14

[52] U.S. Cl. ..... 473/300; 473/305; 473/322

[58] Field of Search ..... 473/322, 305, 473/306, 307, 308, 309, 316, 300

[56] References Cited

U.S. PATENT DOCUMENTS

| | | | |
|---|---|---|---|
| 1,239,356 | 9/1917 | Cochrane | 473/322 |
| 1,480,056 | 1/1924 | Flint | 473/322 |
| 1,486,572 | 3/1924 | Fursyth | 473/322 |
| 1,551,203 | 8/1925 | Mills | 473/322 |
| 1,591,363 | 7/1926 | Cowdery | 473/316 |
| 1,644,510 | 10/1927 | Buhrke | 473/308 |
| 4,405,002 | 9/1983 | Catalano | 144/2.1 |
| 5,390,922 | 2/1995 | Cornish | 473/317 |
| 5,429,703 | 7/1995 | Hartman | 473/300 |
| 5,509,660 | 4/1996 | Elmer | 473/330 |

*Primary Examiner*—Sebastiano Passaniti
*Assistant Examiner*—Stephen L. Blau
*Attorney, Agent, or Firm*—John R. Ross

[57] ABSTRACT

A golf club with shaft made from bamboo strips. The steps involved in making a shaft from bamboo include: dividing a bamboo cane into at least five strips of bamboo, trimming the bamboo strips to size, gluing the bamboo strips together to form a head end and grip end, and installing a golf club head on the head end and a grip on the grip end. The shaft can be tapered or straight, have just one layer or more than one layer of bamboo, it can be solid, hollow or have a center made out of another material such as steel.

3 Claims, 11 Drawing Sheets

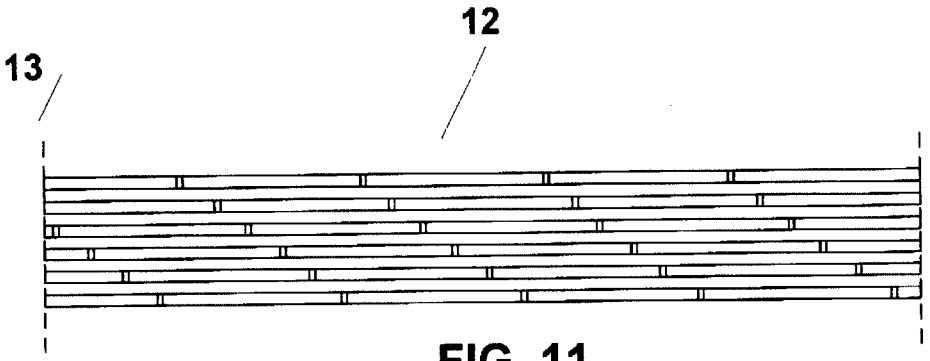
FIG. 11
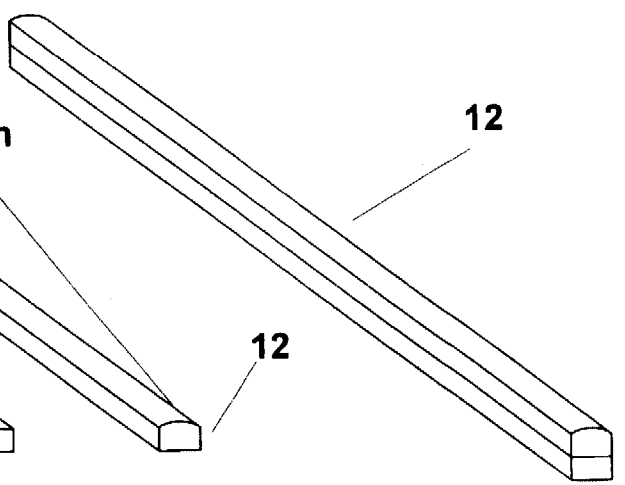
FIG. 13C
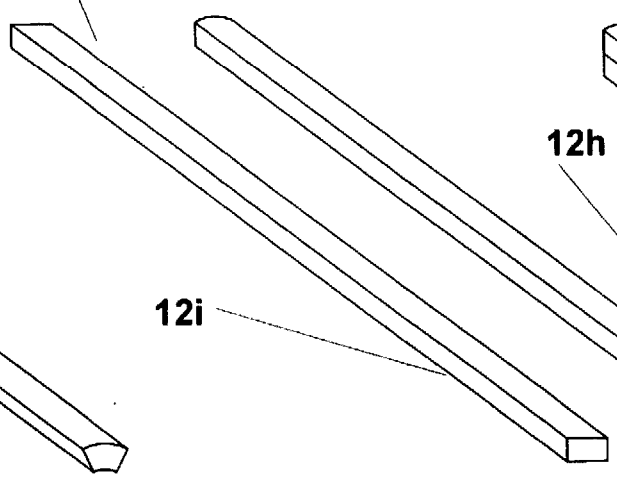
FIG. 13B
FIG. 13A
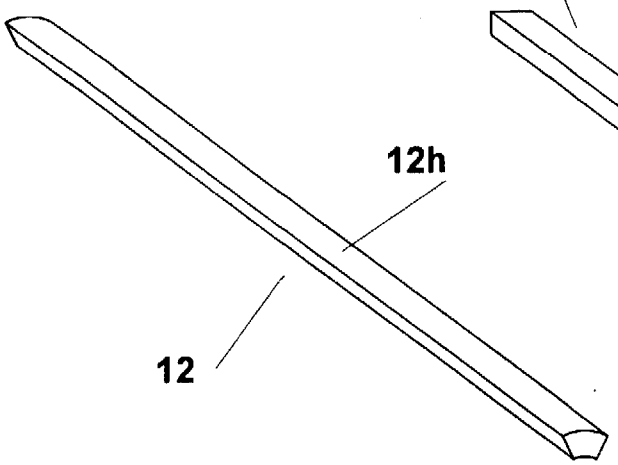
FIG. 12

BAMBOO GOLF CLUB SHAFT

BACKGROUND OF THE INVENTION

The origins of the game of golf can be traced back over 500 years ago when the Scottish Parliament in 1457 recorded a ban on the game because it was seriously interfering with archery practice. However, the appeal of the game of golf could not be held back and over the years it spread to England, Ireland, the United States and is now virtually played all over the world.

As the sport evolved, so did the equipment with which it was played. The shaft of the golf club, was initially made out of solid wood. The wooden shaft was continually used until 1929 when the Royal and Ancient Golf Club approved a seamless shaft of high carbon steel which could be heat-treated and tempered. With the shaft made out of steel, the player had a more flexible club that was capable of imparting a greater "whip" onto the ball. By the 1930's, the steel shaft had substantially replaced the wood shaft.

Advancements and experimentation in shaft design continued as players became ever more demanding of their shaft's performance.

Presently, shafts are available in not only steel, but aluminum, graphite, fiberglass and titanium. Each modern material can boast its own unique flex and weight characteristics. Unfortunately, the process of making a modern steel, aluminum, graphite, fiberglass or titanium golf club is extremely complicated and requires expensive and sophisticated machinery.

Some old wooden shaft clubs are still available, although these clubs often are used as decoration rather than as clubs to play with. Many golfers consider the wooden clubs more elegant than the clubs with shafts made of modern materials.

Fly fishing, like golf, is an old sport that is still very popular worldwide. Most modern fly fishing rods are made out of sophisticated materials such as graphite and fiberglass. However, a small craft industry has existed for many years in which fly fishing rods are made from laminated strips of bamboo. At least three books are available explaining techniques for making fly rods from bamboo: 1) Cattanach, Wayne. *Handcrafting Bamboo Fly Rods*. W. Cattanach Rod Co, 1992. 2) Carmichael, Hoagy B. *A Master's Guide to Building A Bamboo Fly Rod*. Meadow Run Press, 1994. 3) Kreider, Claude M. *The Bamboo Rod: And How to Build It*. The Macmillan Company, 1979. A fly fisherman can make his own fishing rod in his garage with high performance characteristics and it may be capable of outperforming a modern fiberglass or graphite rod. What is needed is a golf club shaft that has high performance characteristics and can be made easily at a builder's home workshop.

SUMMARY OF THE INVENTION

The present invention provides a golf club with shaft made from bamboo strips. The steps involved in making a shaft from bamboo include: dividing a bamboo cane into at least five strips of bamboo, trimming the bamboo strips to size, gluing the bamboo strips together to form a head end and grip end, and installing a golf club head on the head end and a grip on the grip end. The shaft can be tapered or straight, have just one layer or more than one layer of bamboo, it can be solid, hollow or have a center made out of another material such as steel.

BRIEF DESCRIPTION OF THE DRAWINGS

FIG. 11 is a drawing showing the strips cut to size.

FIG. 12 is a drawing that shows a strip prior to being planed to being roughly square.

FIGS. 13A–13B are drawings that shows an outer strip and an inner strip after being planed roughly rectangular.

FIG. 13C is a drawing that shows an outer strip and an inner strip glued together.

DETAILED DESCRIPTION OF PREFERRED EMBODIMENTS

A preferred embodiment of the present invention can be described by reference to FIGS. 1–23. (FIGS. 1–22, with the exception of FIGS. 15, 21, and 23, are presented such that the width has been exaggerated in relation to the length for the purpose of providing optimum clarity.)

Dividing Bamboo Cane Into Strips

Figure 2:
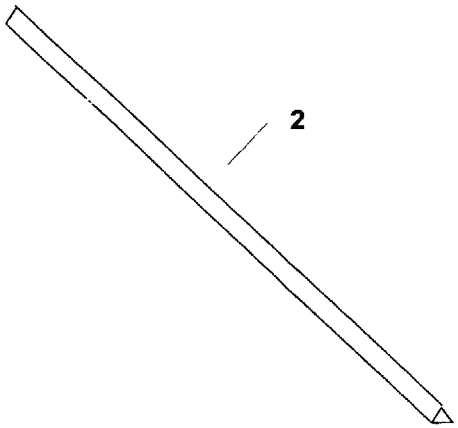
FIG. 2 is a drawing of a bamboo strip from which the shaft is made.
Figure 1:
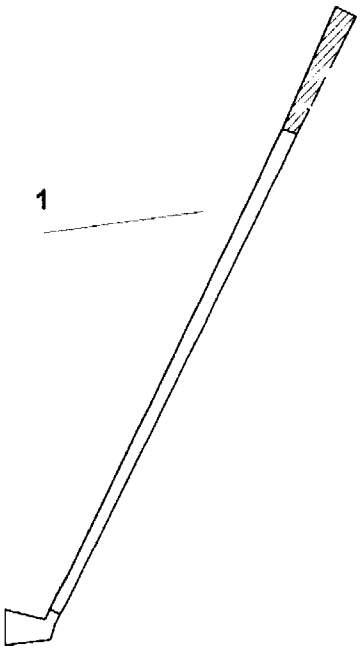
FIG. 1 is a drawing of a golf club.
Figure 3:
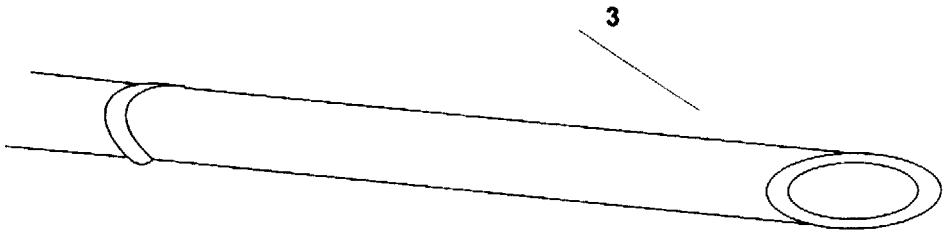
FIG. 3 is drawing of a harvested bamboo cane section.

FIG. 1 shows a golf club with shaft 1. FIG. 3 shows a section of harvested bamboo cane 3 from which shaft 1 is made. FIG. 2 shows one of the triangular strips 2 that are cut out from bamboo cane 3 in order to make shaft 1. Bamboo cane 3 preferably is tan or yellow in color. A green tinge in the cane 3 is an indication of moisture which could cause warping of shaft 1. The preferred cane is known as "*Arundinaria amabilis*" or tonkin bamboo. This species is grown only in the adjoining provinces of Kwangsi and Kwantung, in an area that is 20 to 30 miles along the Sui river in China. The cane is available through the Charles H. Demarest Co., PO Box 238, Bloomingdale, N.J. 07403. The cane, preferably, should be approximately straight over a section of at least about 50 inches. The space between the nodes should preferably be about 8 inches or greater. Diameter should be at least 1½ inches. Preferably, shaft 1 is made from strips 2 that all come from the same bamboo cane 3. Mixed strips from different bamboo canes 3 may set up opposing stresses in the shaft 1 that could cause slight warping or unreliable action.

Figure 4:
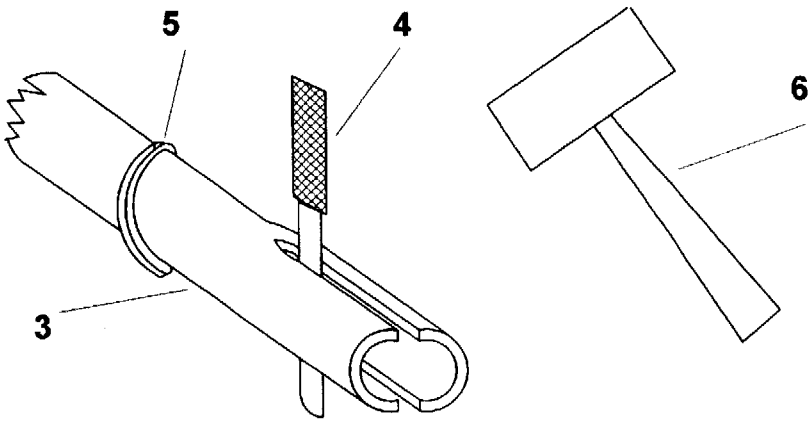
FIG. 4 is drawing showing how the bamboo cane is split.
Figure 5:
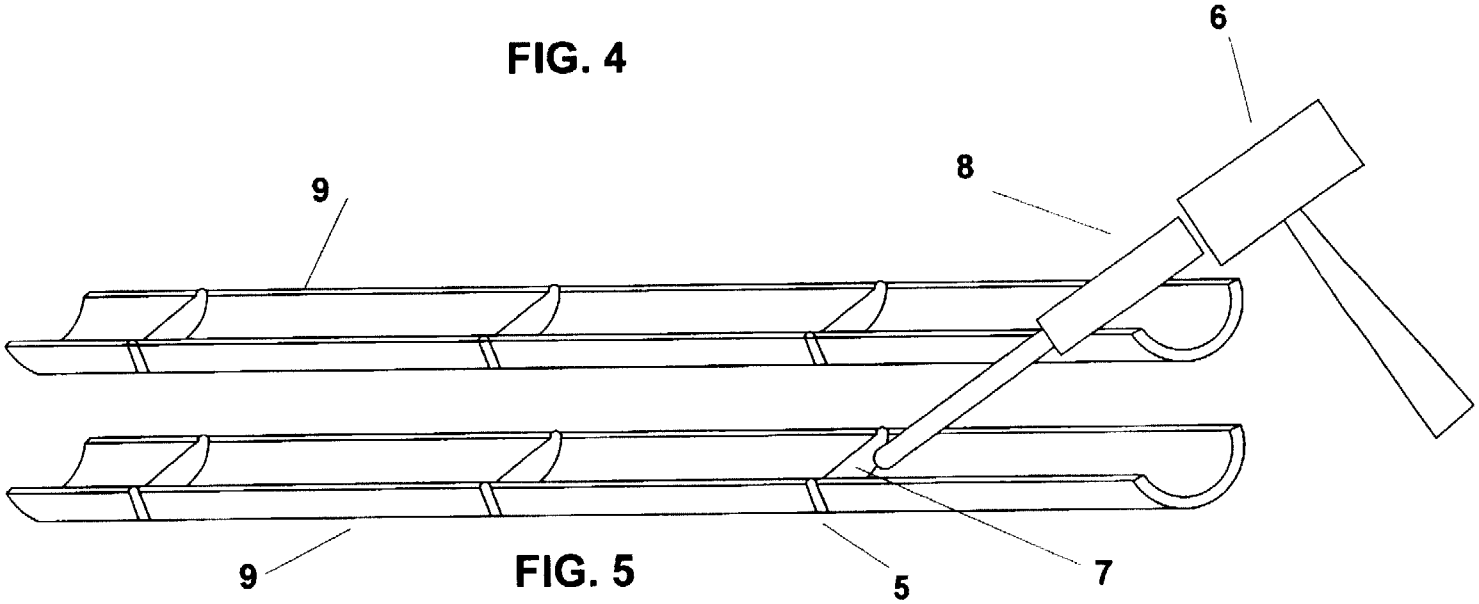
FIG. 5 is a drawing showing how the half-dams are removed from the split cane.

Bamboo cane section 3 is split in half by knife 4 as shown in FIG. 4. Knife 4 is started at butt end of cane 3 with a sharp tap of a mallet 6. Knife 4 is forced down to the first node 5 by hand and using a twisting motion. Knife 4 is tapped again with mallet 6 to break through node 5. The procedure is continued until bamboo cane 3 is split into two cane splits 9, as shown in FIG. 5. Each half-dam 7 is knocked out at each node 5 by striking half-round chisel 8 with mallet 6.

Figure 6:
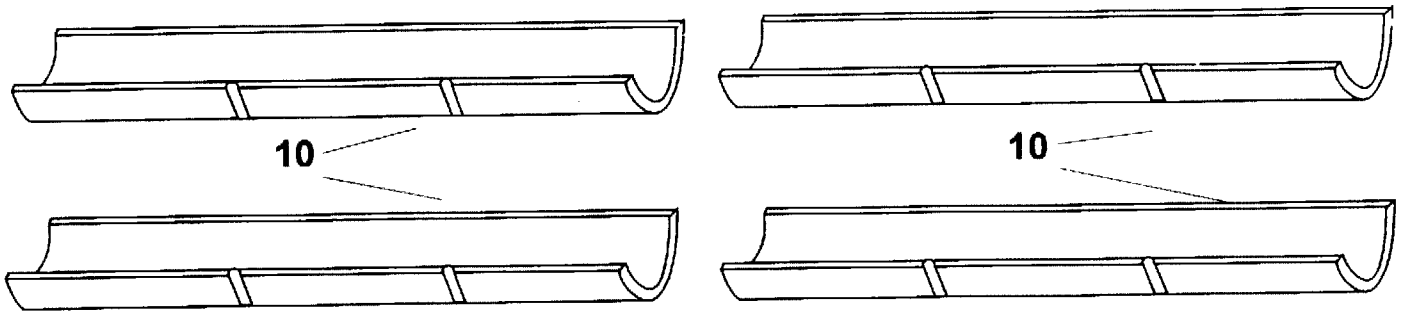
FIG. 6 is a drawing showing four split cane sections with the half-dams removed.
Figure 8:
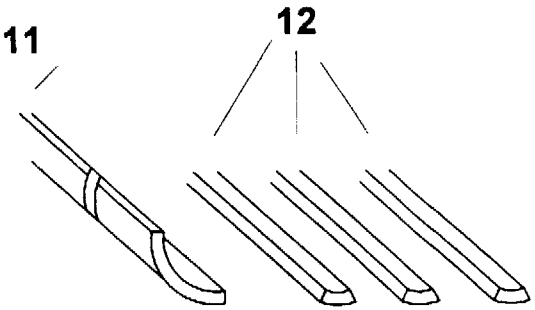
FIGS. 7–8 are drawings showing how to further split the cane into strips.
Figure 7:
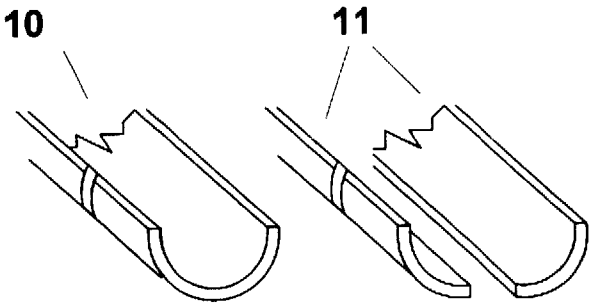

Each cane split 9 is sawed into two cane halves 10, as shown in FIG. 6. Each cane half 10 is split into cane quarter-splits 11 as shown in FIG. 7. Each cane quarter-split 11 is further split into strips 12, as shown in FIG. 8. The result, strips 12, are strips about 50 inches long with an approximately rectangular cross section. The surface which was originally part of the outside surface of the cane (which is slightly convex) will hereinafter be referred to as the "outside surface". The opposite surface (which is slightly concave) will be referred to as the "inside surface". The other two surfaces will be referred to as edge surfaces.

Figure 9:
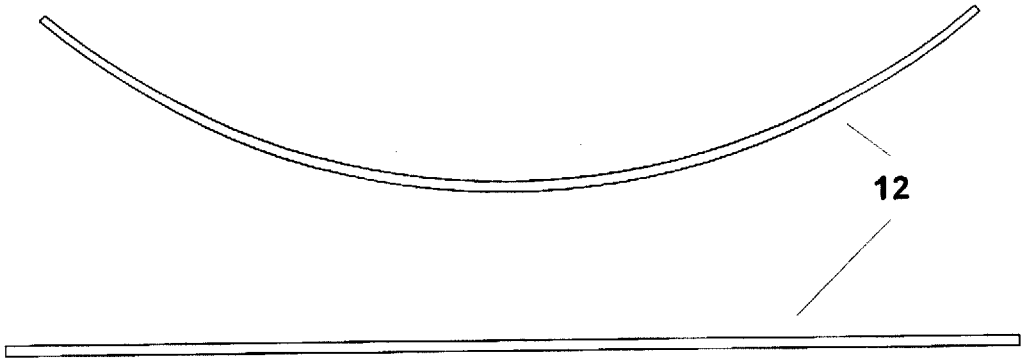
FIG. 9 is a drawing showing how to test the strength of a strip.

The quality of each strip 12 is tested by bending each strip 12 by hand to a semi-circular arc. If it does not spring back to its original shape as shown in FIG. 9, there is most likely a defect with the strip and it should be discarded.

Figure 10:
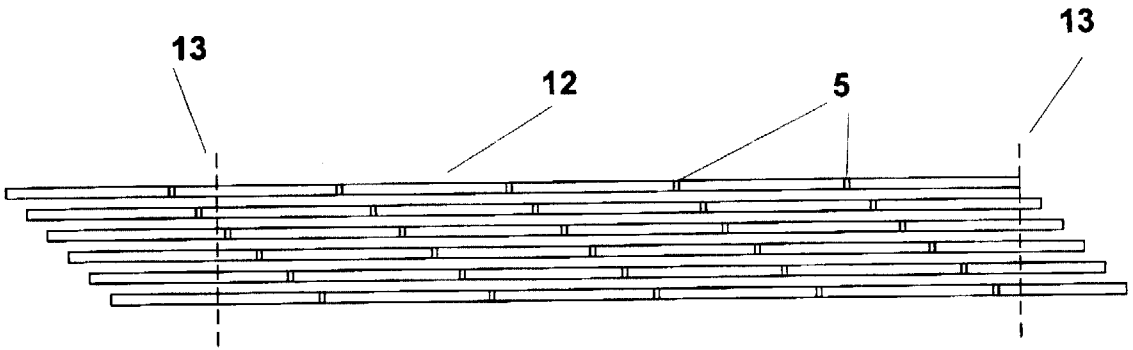
FIG. 10 is a drawing showing how to arrange the strips prior to cutting them to size.

Two lines 13 are marked off forty-two inches apart, as shown in FIG. 10. Six of the strips 12 are laid side by side over the marks 13 and each one is moved past its neighbor so that there is maximum separation of nodes 5 (the weakest part of strip 12). The projecting ends of strips 12 are sawed off at the lines 13, as shown in FIG. 11.

External nodes 5 are filed off so that strip 12 becomes smooth on its outside surface **12*h*, as shown in FIG. 12. It may be necessary to straighten a warped strip 12. While wearing work gloves, strip 12 is passed over a gas burner or hot stove until the strip is warm. Strip 12** is then bent as necessary until it is substantially straight.

Laminating for Thicker Strips

The builder decides how many layers of strips 12 he wants for golf club shaft 1. Two layers are preferred in most cases, but depending on the cane used and other factors, one to three or four layers could be utilized. The more layers of strips 12 that are used, the thicker shaft 1 can be. Preferably, shaft 1 will have two layers of bamboo strips 12. For a two layer shaft 1 that has a total of twelve strips 12, six of strips 12 will comprise the outer layer of shaft 1 and six of strips 12 will comprise the inner layer of shaft 1. Outer layer strips 12 are planed so that its shape becomes roughly rectangular as shown in FIG. 13B except for outside surface **12*h*. Outside surface 12*h* should not be disturbed while planing. Inner layer strips 12*i* are planed so that its shape becomes roughly rectangular including outside surface 12*h*. When planing flat inner layer strip 12*i*, care should be taken so that only a minimum amount of fibers beneath outside surface 12*h* is planed away. Six outer layer strips 12 are glued to six inner layer strips 12*i* to form six strips 12, as shown in FIG. 13C**.

Trimming the Strips

Figure 14:
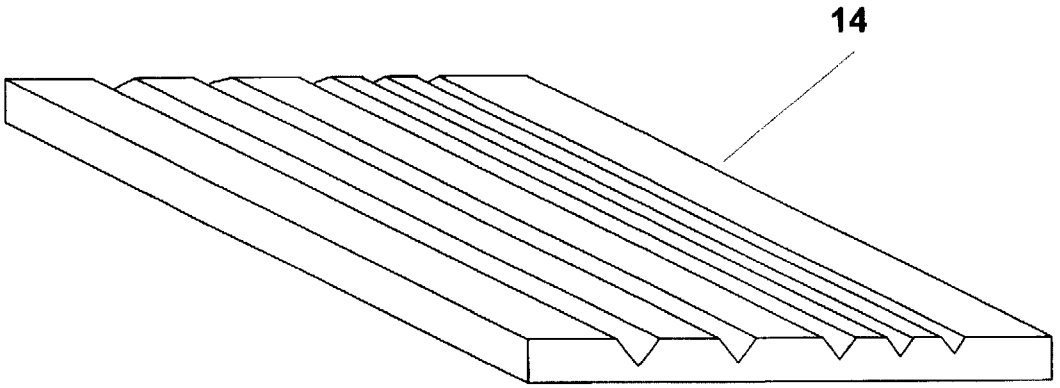
FIG. 14 is a drawing that shows a planing form.

A planing form 14 is prepared, as shown in FIG. 14. Preferably, planing form 14 is custom built from mild steel by a qualified machinist to specific dimensions. Planing form 14 provides a variety of elongated triangular slots. The form is 48 inches long and the slots taper in depth from one end to the other. For a shaft with a thickness of 0.626 inches at the wider end and 0.514 inches at the narrower end, the triangular slot should have a depth of 0.313 inches at one end and 0.257 inches at the other end (i.e., approximately equal to one half of the desired thicknesses of the completed shaft.). Slots of various smaller and longer depths can be provided on planing form 14.

Figure 15C:
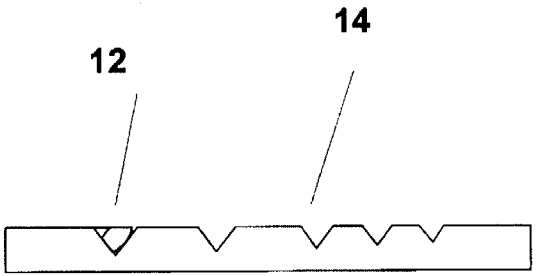
FIGS. 15A–15C are drawings that show how to plane the strip by using the planing form.
Figure 15B:
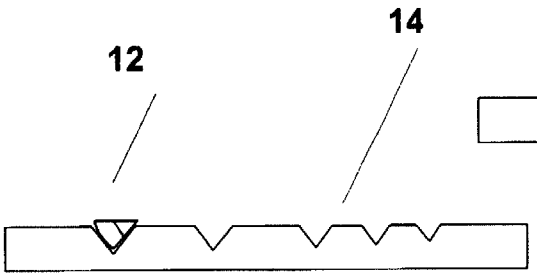
Figure 15A:
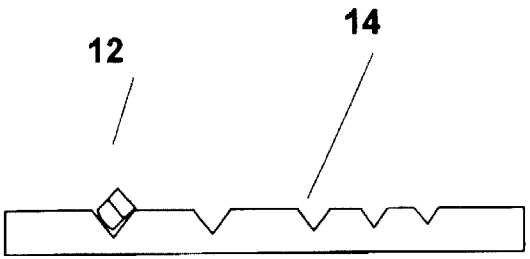

Strip 12 is laid in the largest groove of the form 14, as shown in FIG. **15*a*. While planing strip 12, outside surface 12*h* should always remains against one of the sides of the form so that the outside surface with the enamel is not planed. Short, overlapping plane strokes are used to take off the first corner of strip 12, as shown in FIG. 15*b*. The strip is turned so that the outside surface is now resting against the other side of the plane form. This process is continued until strip 12 is level with the top of form 14, as shown in FIG. 15*c*. Each planed surface of strip 12** is lightly sanded. Thus, we end up with an enamel covered outside surface and two planed surfaces. These planed surfaces are in this embodiment very flat so that each of the two planed surfaces of each strip will mate well with one of the two planed surfaces of another strip. Therefore, I will call these planed surfaces "mating surfaces". As indicated, they preferably are flat; however, they could be other shapes (such as concave and convex) so long as a mating surface of one strip will mate well with a corresponding mating surface of another strip.

Drying the Strips

Figure 16:
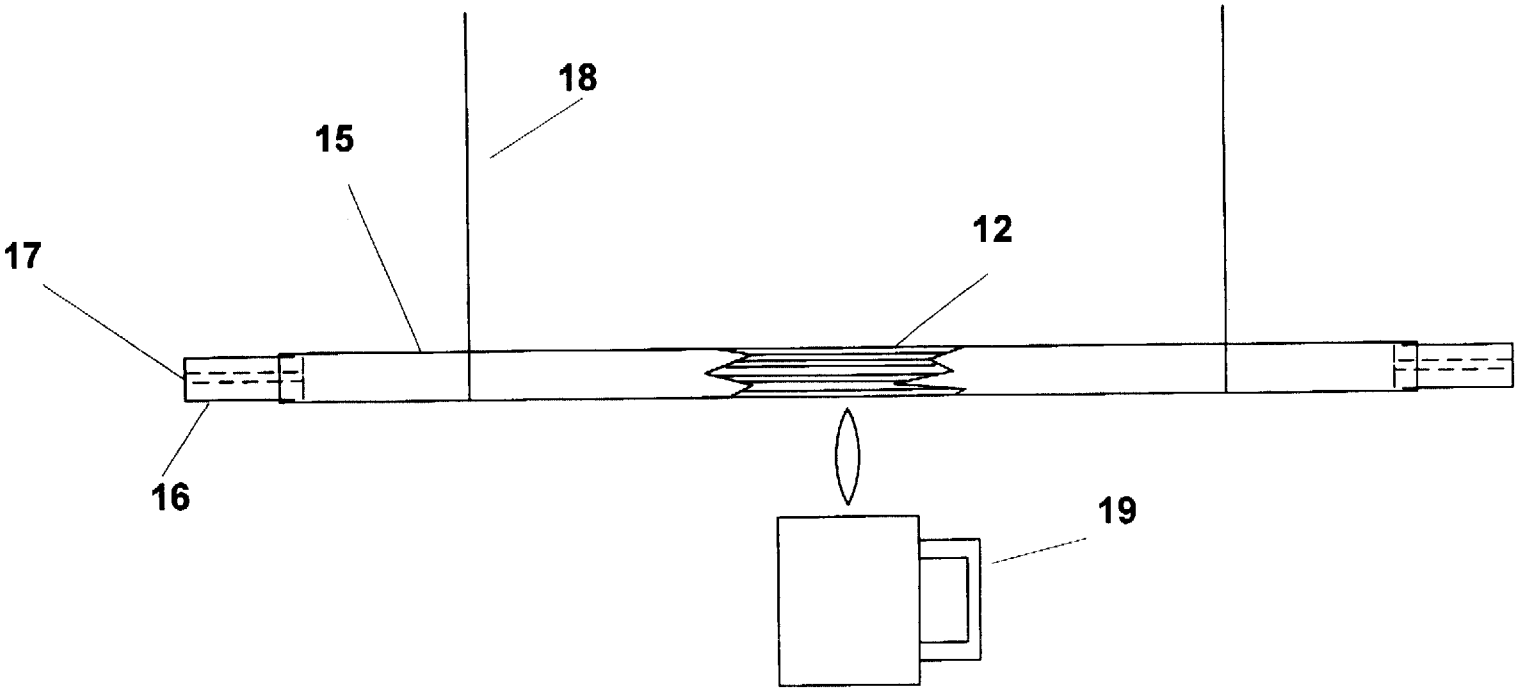
FIG. 16 is a drawing that shows how to heat treat the strips.

Strips 12 are placed into pipe 15, as shown in FIG. 16. In the preferred embodiment pipe 15 is a galvanized iron pipe about 1½ inches in diameter and 6 inches longer than the strip 12. Each end of pipe 15 is plugged with wood plug 16. In the preferred embodiment, wood plug 16 is made of soft-wood and has a ⅛ inch hole 17 drilled through it to allow for escape of vapor. Pipe 15 is suspended from the ceiling with wire 18. Direct flame from torch 19 is applied to the full length of pipe 15, which should be turned every few seconds with a gloved hand grasping one of the plugs 16. Pipe 15 should be heated slowly and equally. Vapor that was inside of strips 12 will be seen escaping through plug hole 17. When all the vapor has left strips 12, the flame should be removed from pipe 15 and the heat tempered strips 12 should be removed from pipe 15.

Assembling the Strips

Figure 18:
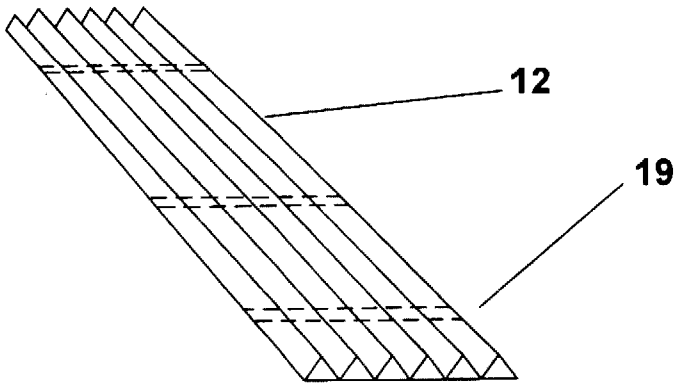
FIGS. 17–18 are drawings that show how to tape the strips prior to gluing.
Figure 17:
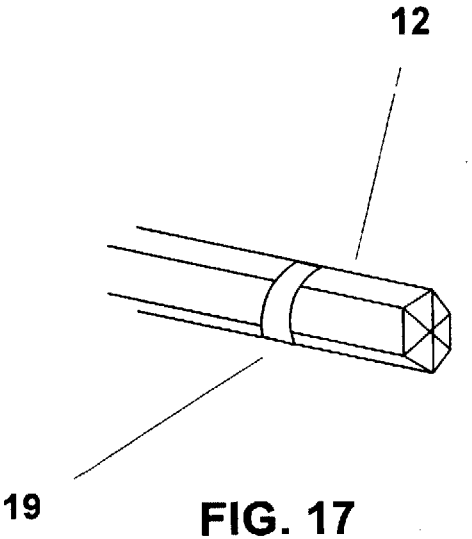

Six strips 12 are then taped together with masking tape 19, as shown in FIG. 17. Masking tape 19 is wrapped around strips 12 at each end and in the middle of strips 12. Each masking tape 19 is cut with a razor blade along an apex of the bundled strips 12. Strips 12 are then laid flat on a vertical surface while still being held together by masking tape 19, as shown in FIG. 18. URAC 185 glue, available from Nelson Paint Co. with offices at PO Box 2040, Iron Mountain, Mich. 49802, is generously applied to each interior side of strips 12. Strips 12 are rolled back together and masking tape 19 is removed.

Figure 19:
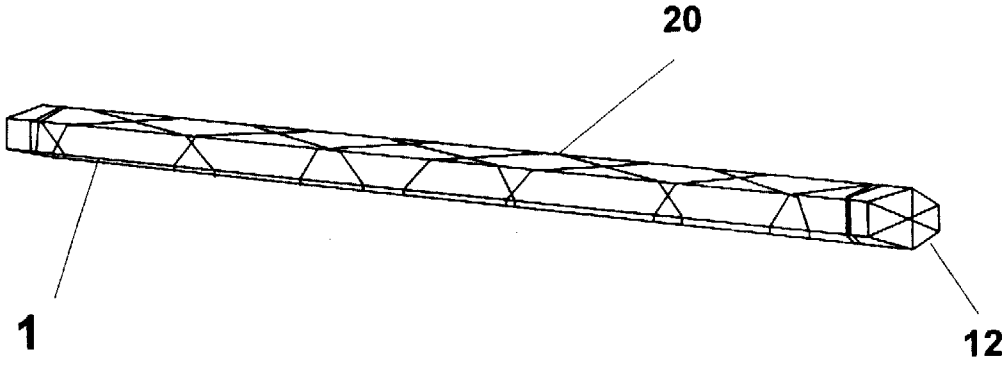
FIG. 19 is a drawing that shows how to tightly bind the strips with string.

String 20 is wrapped around strips 12 tightly enough so that only a very thin layer of glue remains between strips 12, as shown in FIG. 19. If a pressure wrapping machine such as The Olsen Binder (supplied by William Olsen with offices at 26121 Lawrence Road, Charlottesville, Va. 22901) is available, it could be used to wrap strips 12. The builder then sights down the shaft and, while the glue is still wet, adjusts the strips 12 so that shaft 1 is perfectly straight. Shaft 1 is then wiped with a wet rag to remove any exterior glue.

Shaft 1 is hung vertically from nails for 2 weeks in a room with the temperature between 80–85 degrees fahrenheit and low humidity. At the beginning of the third week, string 20 is removed. Lengthwise strokes of '0' grit sandpaper is used to remove excess glue and the bamboo's enamel that is still on the outside of shaft 1. Shaft 1 is then fine sanded with No. 4-0 garnet paper and finally polished with No. 00 steel wool. Shaft 1 is hung vertically for 3 more weeks in a room with low humidity and the temperature between 80–85 degrees fahrenheit. At the end of the third week, shaft 1 is rechecked to ensure that it is straight. If any bend is noticed, shaft 1 should be slightly heated by holding it over a stove burner. Care should be taken so as to only slightly increase the temperature as too much heat could damage shaft 1. After shaft 1 has been heated, the warped section is removed by counter-bending the shaft against the warped section.

Installing Head and Grip

Figure 20:
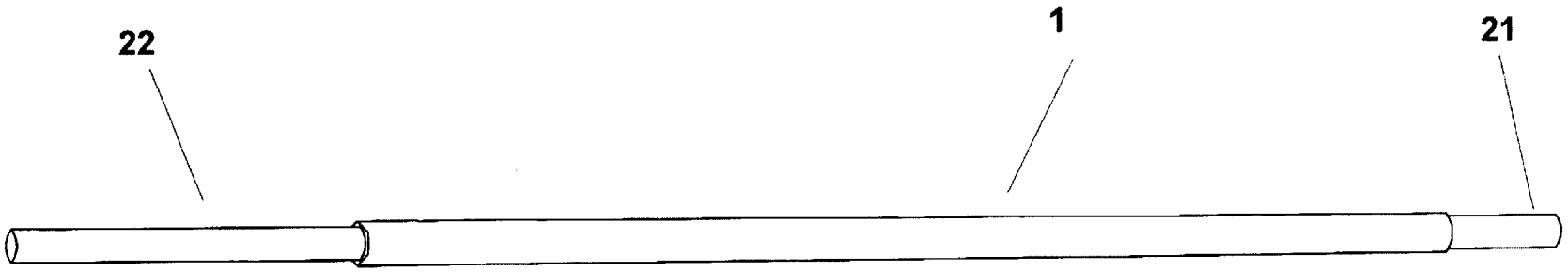
FIG. 20 is a drawing that shows the shaft with its ends file round to attach the grip and head.
Figure 21:
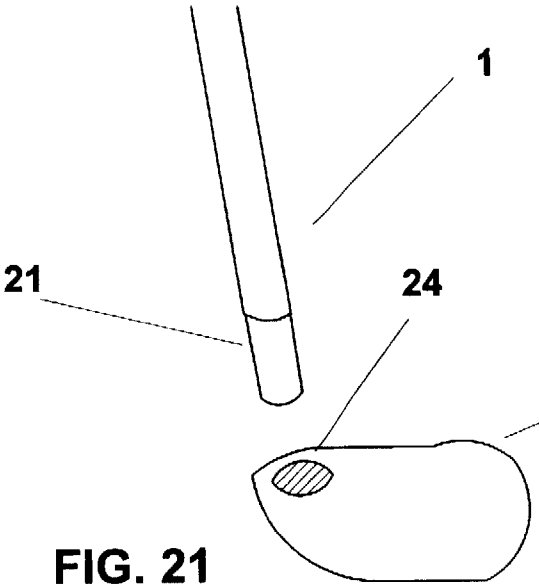
FIG. 21 is a drawing that shows how to attach the head.

Head-end 21 of shaft 1 is filed so that the shape of shaft 1 becomes round 1½ inches from the smaller end of shaft 1, as shown in FIG. 20. Grip-end 22 of shaft 1 is filed so that the shape of shaft 1 becomes round 10 inches from the larger end of shaft 1.

Figure 22:
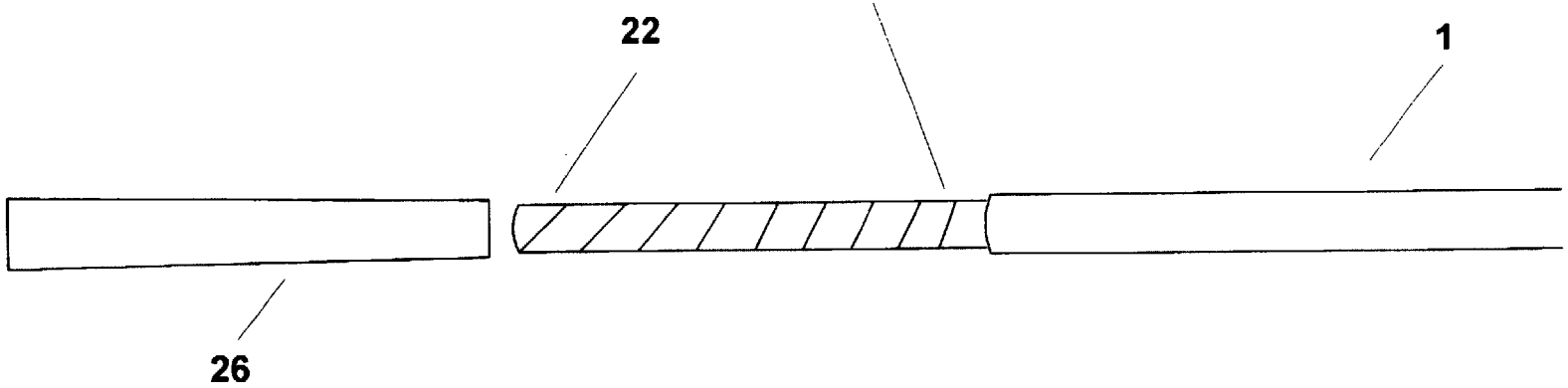
FIG. 22 is a drawing that shows how to attach the grip.

Head-end 21 is dipped in glue and then firmly inserted into hole 24 of head 23, as shown in FIG. 21. Glue is allowed to harden which permanently attaches head 23 to head-end 21. Double-sided tape 25 is wrapped around grip-end 22, as shown in FIG. 22. Grip 26 is slipped over grip-end 22 and is permanently held in place by double-sided tape 25.

After head 23 and grip 26 is attached to shaft 1, a coat of fine varnish is applied to protect the shaft from moisture and abrasion during use.

Figure 23A:
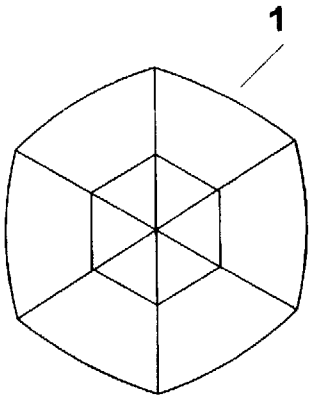
FIG. 23A shows a cross sectional view of the preferred embodiment.

Applicant has constructed a prototype 5-wood in accordance with the teachings of this specification. A cross sectional view of the prototype is shown in FIG. 23A. This prototype used six two-layer laminated strips to produce a shaft which has a thickness of 0.600 inches at the grip end and 0.300 inches at the head end. The club was tested at a driving range by applicant, his son, his patent attorney, and a golf professional. Applicant, his son and his attorney hit better, longer drives with the prototype than with a standard club. The pro hooked slightly with most of his drives. His opinion was that the shaft had somewhat more flex than typical shafts, which resulted in a very large 'kick' which he said would result in longer drives for weaker players. He felt that for strong golfers, a stiffer shaft would be preferable. Additional stiffness could be provided by several well known techniques, such as making the shaft thicker in the lower regions.

Figure 23B:
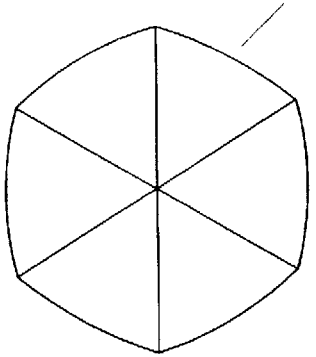
FIGS. 23B–23C show cross sectional views of alternative embodiments.
Figure 23C:
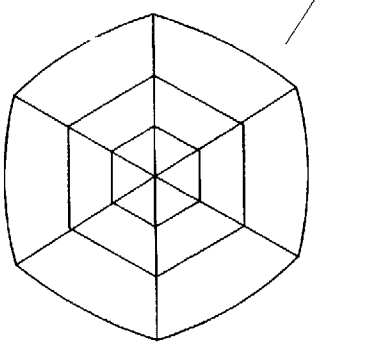
Figure 23D:
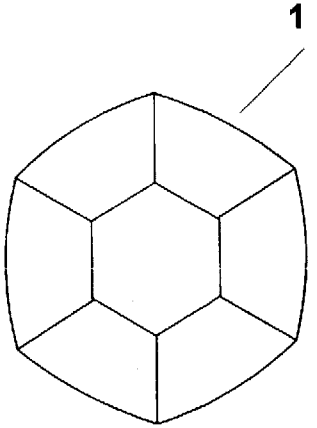
Figure 23E:
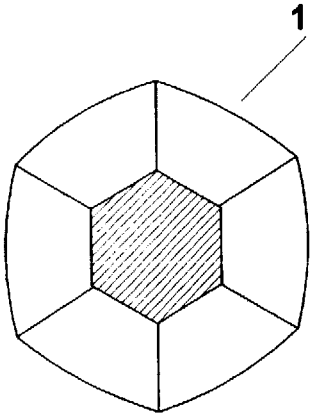
Figure 23F:
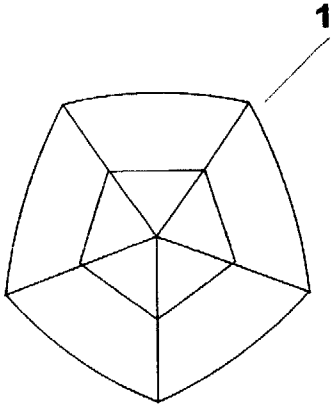

Although the description above contains many specificities, these should not be construed as limiting the scope of the invention but as merely providing illustrations of some of the presently preferred embodiments of this invention. For example, some other possibilities are: the shaft could be built so that there is just one layer of bamboo, as shown in FIG. 23B. Or the shaft could be built so that there are 3 or more layers of bamboo, as shown in FIG. 23C. It is also possible to make the inside of the shaft hollow as shown in FIG. 23D, or to have a center of the shaft made out of a different material (i.e., steel), as shown in FIG. 23E.

Accordingly, reference should be made to the following appended claims in determining the full scope of the invention.

I claim:

1. A method of making a golf club comprising the steps of:

A) dividing bamboo cane into at least five bamboo strips, wherein said bamboo cane is tonkin bamboo, approximately straight over a section of at least 50 inches, nodes are spaced at 8 inches or greater, and diameter is at least 1½ inches, B) trimming said at least five bamboo strips, wherein said strips are trimmed using a planer and form, C) gluing said at least five of said strips together to form a golf club shaft defining a head end and a grip end, wherein said strips are glued together using glue, string and tape, D) installing a golf club head at said head end of said shaft, wherein said head end is trimmed to fit tightly in a hole in said golf club head and is held in place in said head with glue, E) filing round said grip end of said shaft and installing a golf club grip at said grip end of said shaft, wherein said grip is attached to said shaft by using a double-side tape and solvent, and F) applying a protective coat of varnish.

2. A method of making a golf club comprising the steps of:

A) dividing bamboo into at least 10 strips, each of said ten strips defining an outside surface and an inside surface, wherein said bamboo case is tonkin bamboo, approximately straight over a section of at least 50 inches, nodes are spaced at 8 inches or greater, and diameter is at least 1½ inches, B) producing at least five laminated strips, each of said laminated strips being produced by gluing together at least two of said at least ten strips, C) trimming said at least five laminated strips to form at least two mating surfaces on each laminated strip, wherein said strips are trimmed using a planer and planing form, D) gluing at least five of said at least five laminated strips together to form a golf club shaft, wherein said strips are glued together using glue, string and tape, E) installing a golf club head at said head end of said shaft, wherein said head end is trimmed to fit tightly in a hole in said golf club head and is held in place in said head with glue, F) filing round said grip end of said shaft and installing a golf club grip at said grip end of said shaft, wherein said grip is attached to said shaft by using a double-side tape and solvent, and G) applying a protective coat of varnish.

3. A golf club comprising:

A) a shaft comprised of a plurality of strips of bamboo and defining a head end and a grip end, wherein said plurality of strips of bamboo is at least five strips of bamboo, wherein said bamboo is tonkin bamboo, approximately straight over a section of at least 50 inches, nodes are spaced at 8 inches or greater, and diameter is at least 1½ inches, wherein said strips are tapered and held together by glue, wherein said glue is URAC 185 glue, wherein said shaft contains a protective coat of varnish, B) a golf club head attached at said head end, wherein said head end is trimmed to fit tightly in a hole in said golf club head and is held in place in said head with glue, and C) said grip end of said shaft is filed round and a padded grip attached at said grip end, wherein said grip is attached to said shaft by using a double-side tape and solvent.

* * * * *